US008287983B2

(12) United States Patent
Emirze et al.

(10) Patent No.: US 8,287,983 B2
(45) Date of Patent: Oct. 16, 2012

(54) VELOUR NEEDLE-PUNCHED NONWOVEN MATERIAL AND USE THEREOF

(75) Inventors: Ararad Emirze, Kaiserslautern (DE); Martin Buechsel, Chapel Hill, NC (US); Jan-Peter Zilg, Weinheim (DE); Ulrike Maass, Kaiserslautern (DE); Jeffrey Stine, Wake Forest, NC (US)

(73) Assignee: Carl Freudenberg KG, Weinheim (DE)

( * ) Notice: Subject to any disclaimer, the term of this patent is extended or adjusted under 35 U.S.C. 154(b) by 645 days.

(21) Appl. No.: 12/234,489

(22) Filed: Sep. 19, 2008

(65) Prior Publication Data

US 2009/0117804 A1 May 7, 2009

Related U.S. Application Data

(60) Provisional application No. 60/973,913, filed on Sep. 20, 2007.

(51) Int. Cl.
*B32B 33/00* (2006.01)
*D04H 3/16* (2006.01)
*D04H 13/00* (2006.01)

(52) U.S. Cl. ..... 428/97; 428/95; 428/96

(58) Field of Classification Search ..... 428/97, 428/95, 92, 96; 442/361, 362, 363, 364, 442/381, 382, 383, 401, 402, 409
See application file for complete search history.

(56) References Cited

U.S. PATENT DOCUMENTS

| | | | | |
|---|---|---|---|---|
| 3,817,817 | A * | 6/1974 | Pickens, Jr. et al. | 428/91 |
| 4,140,071 | A * | 2/1979 | Gee et al. | 112/475.23 |
| 4,342,802 | A * | 8/1982 | Pickens et al. | 428/92 |
| 4,390,582 | A * | 6/1983 | Pickens et al. | 428/85 |
| 4,391,866 | A * | 7/1983 | Pickens et al. | 428/92 |
| 4,651,393 | A | 3/1987 | Dilo et al. | |
| 4,669,163 | A * | 6/1987 | Lux et al. | 492/41 |
| 4,895,780 | A * | 1/1990 | Nissan-Cohen et al. | 430/5 |
| 5,117,541 | A * | 6/1992 | Leuchtenmuller | 28/115 |
| 5,144,730 | A * | 9/1992 | Dilo | 28/109 |
| 5,387,454 | A | 2/1995 | Werner | |
| 5,473,802 | A * | 12/1995 | Dilo | 28/107 |
| 5,802,682 | A * | 9/1998 | Jourde et al. | 28/107 |
| 5,819,383 | A * | 10/1998 | Jourde et al. | 28/107 |
| 7,779,513 | B2 * | 8/2010 | Dilo | 19/163 |
| 2003/0056883 | A1 | 3/2003 | Bansal et al. | |
| 2008/0299858 | A1 * | 12/2008 | Salmon | 442/381 |
| 2009/0042475 | A1 * | 2/2009 | Pourdeyhimi | 442/335 |
| 2009/0176055 | A1 | 7/2009 | Yada et al. | |
| 2010/0203395 | A1 * | 8/2010 | Toniazzo et al. | 429/247 |
| 2011/0083792 | A1 * | 4/2011 | Vollmert et al. | 156/72 |

FOREIGN PATENT DOCUMENTS

| | | | |
|---|---|---|---|
| DE | 3444763 | | 6/1986 |
| DE | 41 06 295 | | 9/1992 |
| DE | 4409771 | | 10/1994 |
| DE | 19823272 | | 12/1999 |
| DE | 19826981 | | 12/1999 |
| EP | 0411647 | | 2/1991 |
| FR | 2704007 | | 10/1994 |
| JP | 3-167359 | | 7/1991 |
| JP | 03234854 | A * | 10/1991 |
| JP | 6-299453 | | 10/1994 |
| JP | 6-346356 | | 12/1994 |
| JP | 7-268761 | | 10/1995 |
| JP | 10-273860 | | 10/1998 |
| JP | 11-241266 | | 9/1999 |
| JP | 11241260 | A * | 9/1999 |
| JP | 11241267 | A * | 9/1999 |
| JP | 2007-161153 | | 6/2007 |
| RU | 2 157 866 | | 10/2000 |
| TW | 207257 | | 6/1981 |
| TW | 201031780 | A * | 9/2010 |
| WO | 9836119 | | 8/1998 |

OTHER PUBLICATIONS

Fung et al., Textiles in Automotive Engineering, Chapeter 7.4 Carpets, 2001, Woodhead Publishing Ltd, pp. 235-238.*
Machine translation of JP 2890555 B2 (equivalent to JP 03-167359 A), May 17, 1999.*
Office Action from corresponding Korean Application No. 10-2010-7007137 dated Dec. 20, 2011.

* cited by examiner

*Primary Examiner* — Cheryl Juska
(74) *Attorney, Agent, or Firm* — Grossman, Tucker, Perreault & Pfleger, PLLC

(57) ABSTRACT

The invention describes a velour needle-punched nonwoven material, which is produced by placing an optionally pre-strengthened nonwoven material on a brush-like stitch base and needling of the nonwoven on this stitch base. The velour needle-punched nonwoven material according to the invention is characterized in that the nonwoven material comprises a spun-bound nonwoven with filaments, wherein the filaments comprise multicomponent filaments with at least one component with a high melting point and at least one thermally activatable component with a low melting point. The velour needle-punched nonwoven material according to the invention not only has excellent mechanical properties, it is also particularly compatible with the environment and health and therefore suited for applications as a textile lining not only in the private field, but particularly in the public domain.

19 Claims, No Drawings

VELOUR NEEDLE-PUNCHED NONWOVEN MATERIAL AND USE THEREOF

CROSS REFERENCE TO RELATED APPLICATIONS

The present application claims the benefit of the filing date of U.S. Provisional Application Ser. No. 60/973,913, filed Sep. 20, 2007, the teachings of which are incorporated herein by reference.

TECHNICAL FIELD

The invention relates to a velour needle-punched nonwoven material, which is produced by placing an optionally pre-strengthened nonwoven on a brush-like support and needling the nonwoven on this subsurface. The invention furthermore relates to preferred uses of the velour needle-punched nonwoven.

STATE OF THE ART

From DE 34 44 763 A1 a device and a method for producing a velour needle-bonded fabric web are known, wherein a pre-needled nonwoven made of staple fibers is placed on a peripheral brush-like needle stitch base and is then needled on the side facing the needle stitch base while forming piles. Since with this method the fibers seized by the needles are needled into the bristles of the needle stitch base, the nonwoven needled in this way is given a velour-like appearance.

So as to increase the distortion resistance of such a velour needle-bonded fabric, DE 44 09 771 A1 furthermore proposes to place the staple fiber nonwoven web on the brush-like support while interposing a layer that has a higher resistance to distortion than the staple fiber nonwoven web, particularly a spun-bound nonwoven, and then continue the method such that during the needling operation the pile fibers are pulled through the layer that has the higher resistance to distortion. According to the document, particular attention must be paid that the base weight of the intermediate layer made of the spun-bound nonwoven is minimized so that for one the pile formation is not impaired by the intermediate layer and secondly the intermediate layer does not interfere with the visual appearance of the velour needle-punched nonwoven made of staple fibers.

Velour needle-punched nonwoven fabrics of the type described above are increasingly used for lining interior motor vehicle spaces. The disadvantage is that 200 to 300 g/m$^2$ of deep-drawing capable latex binder must be added to the velour needle-punched nonwoven material to achieve the necessary resistance to abrasion required for this application. Latex binders are not only extremely expensive, they also comprise volatile organic compounds (VOCs), which leak into the interior of the motor vehicle (fogging). In light of the overall increasing environmental, health and quality awareness, such emissions into interior spaces, for example in motor vehicles, building products or also interior living spaces, are no longer acceptable.

DESCRIPTION OF THE INVENTION

It is the object of the invention to provide a velour needle-punched nonwoven material, particularly for lining interior spaces, which meets the high requirements with respect to environmental and health compatibility and quality and which at the same time is characterized by excellent mechanical properties, such a high resistance to abrasion.

Hereinafter, filaments as defined by the invention shall be interpreted as continuous fibers. On the other hand, staple fibers or fibers shall be interpreted as fibers with a finite length.

According to the invention, it is provided for a velour needle-punched nonwoven material, which is produced by placing an optionally pre-strengthened nonwoven material on a brush-like stitch base and needling of the nonwoven on this stitch base, that the nonwoven material comprises a spun-bound nonwoven with filaments, wherein the filaments comprise multi-component filaments with at least one component with a high melting point and at least one thermally activatable component with a low melting point.

Surprisingly, it was found that with a velour needle-punched nonwoven material of the type described above a very high resistance to abrasion can be achieved, even without the use of an additional chemical binding agent. The latex coating, which is typically applied to the back of the nonwoven material for applications in interior motor vehicle spaces in order to increase the resistance of a velour needle-punched nonwoven material to abrasion, can be completely eliminated. A velour needle-punched nonwoven material according to the invention is thus free of substances that actively cause fogging. The emission of volatile hydrocarbons resulting from the known latex coating is completely avoided with the inventive velour needle-punched nonwoven material. The inventive velour needle-punched nonwoven material thus satisfies maximum requirements with respect to health and environmental compability as well as quality. The elimination of the latex coating additionally results in a considerable cost advantage.

According to the invention, the velour needle-punched nonwoven material comprises a spun-bound nonwoven with filaments. The use of a spun-bound nonwoven has the advantage that it provides the textile surface structure with a certain level of stability in the known manner. Spun-bound nonwovens are furthermore extremely cost-efficient to produce. Unlike staple fiber nonwovens, however, spun-bound nonwovens are characterized by a very smooth, not very bulky appearance. The filaments are provided almost exclusively in a horizontal plane. The materials completely lack fluffiness and velour-like characteristics. Therefore, at first glance, they do not appear suited for forming a velour-like needle-punched nonwoven. The document DE 44 09 771 A1 described at the beginning also expressly mentions that the base weight of the spun-bound nonwoven inserted as a reinforcing layer must be selected low enough so that it is not visually apparent.

Surprisingly, however, it has been found that even with spun-bound nonwovens with high base weights during needling on a brush-like stitch base, such as that described in DE 34 44 763 A1, a fluffy textile surface structure can be achieved, which has a velour-like appearance. Even the recovery of the fluffiness after application of a load, which is important for velour needle-punched nonwovens, is achieved. The needled spun-bound nonwoven maintains its known excellent properties, such as a high resistance to distortion, excellent deformation, high dimensional stability and resistance to abrasion.

The recovery ability, resistance to distortion and dimensional stability of a velour needle-punched nonwoven material according to the invention can be further increased if it is thermally bonded after needling.

A velour needle-punched nonwoven according to the invention can be produced by means of a method as that described, for example, in DE 34 44 763 A1 mentioned above. Special variants of the method, which result in a structuring of the surfaces of a velour needle-punched nonwoven, for example, are also known from EP 0 411 647 A1. In this document, for example, fork and/or crown needles are used, depending on the type of structuring that is desired. Accordingly, single-stage or multi-stage methods are described. These methods can also be used for a velour needle-punched nonwoven material according to the invention, without loss of generality.

According to the invention, the filaments comprise multicomponent filaments with at least one component with a high melting point and at least one thermally activatable component with a low melting point, preferably bicomponent filaments. Bicomponent filaments are known per se. They comprise a component with a low melting point made of a polymer with a low melting point and a component with a high melting point made of a polymer with a high melting point.

According to the invention, the above-mentioned thermally activatable component with a low melting point assumes the function of a binding agent and/or of the latex binder, however without the disadvantages associated with the use of such a binder or other chemical binding agent, such as fogging, low recyclability and the like. The melting point of the component with a low melting point should preferably be 10° C. to 20° C. below the melting point of the component with the higher melting point to ensure that it is not destroyed during thermal activation.

The portion of bicomponent filaments in the spun-bound nonwoven should not be any less than 5% (in relation to the overall base weight of the velour needle-punched nonwoven material), because otherwise the resistance to abrasion would worsen too drastically. It is preferable if the portion exceeds 15%.

The spun-bound nonwoven may comprise one or more layers. It can be made of one or more types of filaments. It is also conceivable to admix staple fibers. The portion of staple fibers, however, should not exceed 75% in relation to the overall base weight of the velour needle-punched nonwoven material, because higher values considerably reduce the resistance to abrasion, tensile strength and dimensional stability.

Also the staple fibers can be made of multicomponent, preferably bicomponent fibers, wherein the above explanations apply to the preferably used polymers.

The admixing of staple fibers can be performed such that the staple fibers are injected in the flow of the spun-bound nonwoven. It is also possible, however, to place the staple fibers on a spun-bound nonwoven layer or between two spun-bound nonwoven layers and introduce the fibers in the spun-bound nonwoven layers by means of the needling process. Furthermore, both layers can be produced separately and be joined in a subsequent step, for example by means of the needling step.

By admixing curled staple fibers, the fluffiness and recovery ability of the fluff can be further improved. This effect can also be achieved by the use of curled continuous filaments.

The addition of staple fibers can advantageously also be used to achieve reproducible and homogeneous coloring of the velour needle-punched nonwoven. The staple fibers are then the sole color carrier. The color is adjusted by metering the dye. Such a reproducible color adjustment can also be achieved by dying the continuous filaments in a continuous spinning process. The staple fiber process, however, is generally considerably more flexible and as a result color changes can be implemented more quickly.

According to the invention, a plurality of different fibers or filaments can be used. The differences may be, for example, the composition or also the fiber or filament thickness. A step-like or even gradient-like configuration of the layers comprising different fibers and/or filaments may even be provided. For example, the formation of discrete transitions between layers comprising different fibers and/or filaments or a continuous enrichment of a filament or fiber type toward one of the surfaces is conceivable. If such a fiber or such a filament comprises a heat activatable binding polymer with a low melting point, in this way an adhesive layer can be formed. In the case of a gradient-like configuration, such a binding polymer additionally contributes to the strengthening and stabilization of the interior of the layer.

Due to its special mechanical stability, health and environmental compatibility and quality, a textile lining comprising a velour needle-punched nonwoven according to the invention is particularly well-suited for applications in the public domain. This domain includes all target groups that cannot be associated with the private domain, such as offices, schools, banks, insurance companies, hotels, the social and medical care sectors, sports facilities, particularly also the interior decorations in the automotive sector, in the shipping industry, the railroad industry etc.

The public domain is subject to extremely high requirements in terms of technical quality. These requirements are met by a textile lining according to the invention. Preferable are applications in the fields of interior motor vehicle lining, both interior passenger compartment and interior trunk lining, as well as carpeting, both as meter goods and also in the form of tiles. However, other applications for such a textile lining are conceivable as well, for example as a wall lining, for partitions and the like. Due to the above explanations, it is obvious that a textile lining according to the invention can also be used in the private sector, for example in the residential field.

A textile lining according to the invention, for example, may also be provided with flame-retardant, anti-static or antimicrobial properties for the above applications.

The possibilities of use for a velour needle-punched nonwoven according to the invention and/or for a textile lining according to the invention are in no way limited to the above-mentioned concrete fields of applications.

Particularly for applications in the area of linings for interior motor vehicle spaces or in the area of carpeting, it may be advantageous if the inventive textile lining is provided with a heavy layer. The use of heavy layers is known per se in the field of interior motor vehicle linings. They serve decoupling purposes according to the mass/spring principle. The heavy layer is either extruded from a PE layer while supplying heat or directly onto the carpet and in this case requires no bonding agent. The heavy layer is usually made of $CaCO_3$ and EVA. On this, a decoupler is applied, such as shoddy cotton, or a foam. According to a preferred embodiment of the invention, the heavy layer may also be applied in the form of a nonwoven, particularly a spun-bond nonwoven. This simplifies not only the method, but is also associated with further advantages, including the aspect of recyclability.

Furthermore, according to a further preferred embodiment a lining according to the invention may be provided with a sound damping layer, either combined with the heavy layer or alone. The sound damping layer can be formed in the known manner by shoddy cotton with an intermediate layer, which limits air permeability, or it can be formed by a microfiber nonwoven in conjunction with shoddy cotton or a needle-punched nonwoven, or by a needle-punched nonwoven per se.

The above-described layers are preferably bonded to one another by means of bonding layers. For the bonding layers, conventional binders can be used. From an environmental and health compatibility aspect and also from economical aspects (simplified method, fewer process steps), according to a particularly preferred embodiment of the invention these bonding layers may also comprise layers of multicomponent filaments and/or fibers, preferably bicomponent filaments and/or fibers. Furthermore, it also possible to use monofilaments or fibers, either additionally or alone, which comprise a polymer with a low melting point, such as a copolymer, for the bonding layer. Chemical binding agents, which can result in the known fogging problem, can be completely foregone in these last embodiments.

For the uses described in the present application, according to a preferred embodiment of the invention the bicomponent filaments and/or fibers are sheath/core, side-by-side, island-in-the-sea and/or pie (also hollow pie) filaments or fibers. Bicomponent filaments or fibers with trilobal geometries or fibers or filaments from spinnerets with round capillary geometries (=concentrated arrangement of binding and matrix polymers) result in improved anchoring of the fibers or filaments in the nonwoven material and thus further improve tensile strength and resistance to abrasion.

The percentage of the multicomponent or bicomponent filaments or fibers can also be used to easily adjust the rigidity of the textile lining. The higher this percentage, the more rigid the material.

The component with the low melting point of the bicomponent filaments or fibers preferably comprises, without loss of generality, COPET (copolyester), COPA (copolyamide), PA (polyamide), PP (polypropylene), copolypropylene (CoPP), atactic PP and/or PE (polyethylene), the component with the high melting point preferably comprises PET (polyester), PA (polyamide), PLA (polylactide), PBT (polybutylene) and/or PP (polypropylene). The same also applies for the at least one component with the low melting point and/or the at least one component with the high melting point of multicomponent filaments and fibers used according to the invention.

According to a further particularly preferred embodiment of the invention, the filaments and/or fibers of all layers are made of one and the same polymer and/or the derivatives thereof. This has the advantage of simpler recyclability. It is preferable if the textile lining is made of polypropylene and/or the derivatives thereof or of polyester and/or the derivatives thereof or of polyamide and/or the derivatives thereof. Particularly for textile linings, formed parts are frequently punched out of meter goods. If the above materials are used, the scrap from punching can be reused for filament and/or staple fiber production.

What is claimed is:

1. A velour needle-punched nonwoven material, which is produced by placing an optionally pre-strengthened nonwoven material on a brush stitch base support and needling of the nonwoven on this stitch base, characterized in that the nonwoven material comprises a spun-bound nonwoven with filaments and staple fibers admixed in the spunbond nonwoven up to 75% of the total base weight of the velour needle-punched nonwoven material, the filaments comprising multicomponent filaments with at least one component with a high melting point and at least one thermally activatable component with a low melting point and wherein said velour needle-punched nonwoven is a thermally bonded nonwoven and said multicomponent filaments function as a binding agent.

2. The velour needle-punched nonwoven material according to claim 1, characterized in that the multicomponent filaments comprise bicomponent filaments.

3. The velour needle-punched nonwoven material according to claim 2, characterized in that the portion of the bicomponent filaments is greater than 5%, in relation to the overall weight of the velour needle-punched nonwoven material.

4. The velour needle-punched material according to claim 2, characterized in that the bicomponent filaments are configured as sheath/core, side-by-side, island-in-the-sea, hollow pie or pie filaments.

5. A velour needle-punched nonwoven material according to claim 2, characterized in that the component with a low melting point of the bicomponent filaments comprises copolyester, copolyamide, polyamide, polypropylene, copolypropylene, atactic polypropylene or polyethylene.

6. A velour needle-punched nonwoven material according to claim 2, characterized in that the component with a high melting point comprises polyester, polylactide, polybutylene, polyamide or polypropylene.

7. A velour needle-punched nonwoven material according to claim 1, characterized in that the staple fibers and/or filaments comprise curled staple fibers and/or filaments.

8. A textile lining comprising at least one layer forming a velour surface made of a velour needle-punched nonwoven material, characterized by a velour needle-punched nonwoven material according to claim 1.

9. The textile lining according to claim 8, characterized in that on the rear surface of the textile lining facing away from the velour surface a heavy layer is provided comprising polyethylene, calcium carbonate and ethylene vinyl-acetate, or nonwoven material.

10. The textile lining according to claim 8, characterized in that on the rear surface of the textile lining facing away from the velour surface a sound damping layer is provided.

11. A textile lining according to claim 8, characterized in that bonding layers are provided between individual or all layers.

12. The textile lining according to claim 11, characterized in that the bonding layers comprise fibers and/or filaments made of a polymer with a low melting point.

13. A textile lining according to claim 11, characterized in that the bonding layers comprise multicomponent fibers and/or filaments, comprising at least one component with a high melting point and at least one component with a low melting point.

14. A textile lining according to claim 12, characterized in that the polymer with a low melting point or the component with a low melting point of the multicomponent or bicomponent fibers and/or filaments comprises copolyester, copolyamide, polyamide, polypropylene, atactic polypropylene or polyethylene.

15. The textile lining according to claim 14, characterized in that the component with a high melting point comprises polyester, polyamide, polylactide, polybutylene or polypropylene.

16. A textile lining according to claim 13, characterized in that the multicomponent fibers and/or filaments comprise bicomponent fibers and/or filaments, wherein said bicomponent fibers and/or filaments are configured as sheath/core, side-by-side, island-in-the-sea, hollow pie or pie filaments.

17. A textile lining according to claim 9, characterized in that the filaments and/or fibers of all layers are made of one and the same polymer and/or the derivatives thereof.

18. The textile lining of claim 8, wherein said textile lining is in the form of a lining for interior motor vehicle spaces.

19. The textile lining of claim 8, wherein said textile lining is in the form of carpeting.

* * * * *